US008118268B2

(12) United States Patent
Mabry

(10) Patent No.: US 8,118,268 B2
(45) Date of Patent: Feb. 21, 2012

(54) HANDS FREE BABY BOTTLE HOLDER AND FEEDER

(76) Inventor: Michael Mabry, Rockville, MD (US)

( * ) Notice: Subject to any disclaimer, the term of this patent is extended or adjusted under 35 U.S.C. 154(b) by 0 days.

(21) Appl. No.: 12/966,975

(22) Filed: Dec. 13, 2010

(65) Prior Publication Data

US 2011/0139944 A1 Jun. 16, 2011

Related U.S. Application Data

(60) Provisional application No. 61/285,994, filed on Dec. 13, 2009.

(51) Int. Cl.
*A47D 15/00* (2006.01)

(52) U.S. Cl. ..... 248/105; 248/102; 5/655

(58) Field of Classification Search ..... 248/105, 248/102
See application file for complete search history.

(56) References Cited

U.S. PATENT DOCUMENTS 4,733,836 A * 3/1988 Barnes ..... 248/106
4,862,535 A 9/1989 Roberts
5,182,828 A 2/1993 Alivizatos
5,233,714 A 8/1993 De Bell Daniel
5,341,531 A 8/1994 Straub et al.
5,439,008 A * 8/1995 Bowman ..... 128/875
6,098,934 A 8/2000 Skelton
6,523,793 B1 * 2/2003 Higgins ..... 248/102
6,961,961 B1 * 11/2005 Ezra ..... 2/49.1
7,386,902 B2 * 6/2008 Wilson ..... 5/655
7,661,636 B1 * 2/2010 Burke ..... 248/102
7,788,752 B2 * 9/2010 Tidwell et al. ..... 5/655
2004/0222334 A1 11/2004 Rich
2005/0103954 A1 5/2005 Touma
2006/0102810 A1 5/2006 Banks
2007/0271703 A1 * 11/2007 Matthews Brown et al. ..... 5/636
2009/0038078 A1 2/2009 House

* cited by examiner

*Primary Examiner* — Amy J Sterling
(74) *Attorney, Agent, or Firm* — Thien Tran, Esq.; Access Patent Group, LLC

(57) ABSTRACT

A hands free baby bottle holder and feeder which includes a wedge shaped pillow and a U-shaped shaped pillow. A mechanism is for attaching the U-shaped pillow in an inverted position onto the wedge shaped pillow. A C-clamp mechanism on the U-shaped pillow is for holding a baby bottle in position, so that an infant placed onto the wedge shaped pillow between the U-shaped pillow can safely drink from the baby bottle.

8 Claims, 4 Drawing Sheets

HANDS FREE BABY BOTTLE HOLDER AND FEEDER

CROSS-REFERENCE TO RELATED APPLICATION

This application claims the benefit of Provisional Patent Application No. 61/285,994, filed on Dec. 13, 2009, in the United States Patent & Trademark Office, the disclosure of which is incorporated herein by reference.

BACKGROUND OF THE INVENTION

1. Field of the Invention

The present invention relates to a holding device for a baby bottle, and more particularly, a hands free baby bottle holder and feeder.

Bottle-feeding an infant usually requires the full attention of the parent or caregiver. It can be impossible to tend to any other duties, such as answering the phone, feeding another infant, cooking dinner, and more. Many parents feel as though they are not able to get enough accomplished in the day. A product is needed that will take the place of an adult's hands and effectively and safely hold a child's baby bottle.

The hands free baby bottle holder and feeder allows an infant to feed from a bottle without a parent or caregiver having to hold the baby bottle. This enables the caregiver to perform other necessary tasks during feeding time, such as care for other children, use the phone, answer the door, and more. It gives parents the freedom to multitask while feeding an infant, without compromising the level of care and security dedicated to the child.

2. Description of the Prior Art

Numerous innovations for restraining pillows and baby bottle supports have been provided in the prior art that will be described. Even though these innovations may be suitable for the specific individual purposes to which they address, however, they differ from the present invention.

A FIRST EXAMPLE, U.S. Pat. No. 4,862,535, Issued on Sep. 5, 1989, to Roberts teaches an anti-reflux support system for an infant comprising a wedge-shaped support pillow having an inclined infant-supporting surface, an infant torso-encircling sling attachable to the infant-supporting surface of the support pillow, and fasteners carried by at least one of the pillow or the slings for securing the sling on the infant-supporting surface in any one of a plurality of positions. The support pillow includes internal spaced, vertically-oriented support baffles extending between the infant-supporting surface and the bottom surface, and a loose, particulate filler material. The filler material cooperates with the support baffles to impart the wedge-shape to the pillow and to permit the infant-supporting surface to be deformed concavely, and thus conform to the shape of the infant's torso, when the infant is placed on the infant-supporting surface. The torso-encircling sling includes a single elongated sheet of soft, preferably absorbent, material which is foldable into a diaper-like garment securable around the lower part of the infant's torso. Fasteners carried by the sling facilitate securing together facing sides of the folded sheet.

A SECOND EXAMPLE, U.S. Pat. No. 5,182,828, Issued on Feb. 2, 1993, to Alivizatos teaches a machine washable wedge shaped support structure that is formed from a fabric envelope loosely filled with lightweight, preferably polystyrene, beads which shape it. The fabric may have a non-skid surface to resist sliding in use. The wedge conforms to a patient's or infant's body. When compressed, the fabric envelope and beads lock into a roll-preventing support structure.

One alternate version has a stabilizing panel extending from the pointed end of the wedge on which a patient lies. Another version has a connecting panel between two opposing triangular shaped wedges. It provides roll preventing support for a pregnant woman and doubles as an anti-roll pad for infants.

A THIRD EXAMPLE, U.S. Pat. No. 5,233,714, Issued on Aug. 10, 1993, to Del Bell Daniel teaches an improved infant restraining device that is adapted for use with a mattress or other infant-supporting structure and which is used for dealing with infants afflicted with gastroesophageal reflux includes an elongated flexible sheet having opposing first and second ends, two opposing side edges each provided with a flared portion capable of being wrapped around respective opposing side edges of the mattress on which the device is placed and cooperating releasable attachment means associated with the first end of the flexible sheet and with each of the flared portions to permit the infant restraining device to be firmly anchored to one end of the mattress when the opposing flared portions are attached to the first end of the flexible sheet on the underside of the mattress. The second end of the flexible sheet is designed to engage the lower torso of an infant and to restrain movement of the infant even though the mattress to which the device is anchored may be inclined at angles up to 45 degrees.

A FOURTH EXAMPLE, U.S. Pat. No. 5,341,531, Issued on Aug. 30, 1994, to Straub et al. teaches a bolster structure for infant side sleeping support and positioning having a rectangular apron to which a first pillow is secured along and adjacent one end thereof. A second pillow is preferably provided which is independently demountably associated with the apron in various orientations with hook and loop fastening means.

A FIFTH EXAMPLE, U.S. Pat. No. 5,439,008, Issued on Aug. 8, 1995, to Bowman teaches an infant reflux restraint apparatus that preferably has a wedge-shaped support member for readily positioning an infant on a support surface to thereby support an infant in a reclined position. A pair of side strips are secured to the wedge-shaped support member and are positioned on an upper surface thereof. The pair of side strips are spaced-apart in a generally parallel relationship and a sufficient amount so that an infant can be positioned therebetween. Each of the pair of side strips also longitudinally extends along adjacent respective sides of the infant. The apparatus further preferably has a head support member connected to the wedge-shaped support member and positioned on an upper medial portion of the upper surface thereof for supporting the infant's head when reclined thereon. A reflux sling member detachably connects to the pair of side strips secured to the wedge-shaped support member and is positionally longitudinally aligned with the head support member for positioning the lower torso of the infant therein when reclined on the wedge-shaped support member.

A SIXTH EXAMPLE, U.S. Pat. No. 6,000,664, issued on Dec. 14, 1999, to Hood teaches a baby bottle support bib intended to be worn by an individual while bottle feeding a baby. A baby bottle is removably attached to the bib so as to be held in the preferred orientation for feeding the baby.

A SEVENTH EXAMPLE, U.S. Pat. No. 6,055,667, issued on May 2, 2000, to Jiminez teaches a bib having a strap for being worn around the neck of an infant. The bib has a compartment within it which houses an irregular shaped wedge made of foam-like material. The wedge can be placed in different positions within the bib so as to change the angle of a bottle in communication with the infant's mouth. Multiple releasable straps connected to the bib hold a bottle or sip cup onto the outer surface of the bib. Means for connecting the ends of the straps are disclosed, including buttons, snaps, hooks, and hook and loop material. Also mating pieces of hook and loop material means are disclosed for connecting the neck strap of the bib to the back of the neck of the infant. An alternative embodiment discloses multiple elastic straps extending from one side of the bib to the other for holding the bottle or sip cup to the bib.

AN EIGHTH EXAMPLE, U.S. Pat. No. 6,098,934, issued on Aug. 8, 2000, to Skelton teaches an apparatus and method of this invention provide a versatile and convenient way to feed infants in a hands free manner while the infant is being transported, especially when being transported in an infant carrier seat. The invention provides a drinking container support apparatus comprised of a wedge shaped member, a drinking container retaining member and a strap for attaching the drinking container support apparatus to a carrier seat. The invention further provides for user selected adjustment of a drinking container to a position that is convenient and accessible to an infant. Another aspect of this invention is a method for feeding an infant while the infant is seated in an infant carrier seat by use of a drinking container support apparatus.

A NINTH EXAMPLE, U.S. Pat. No. 6,523,793, issued on Feb. 25, 2003, to Higgins teaches an infant feeding device for hands-free feeding of an infant. The device has a knee support cushion, a body and head support cushion, and a bottle support cushion. The cushions are secured onto a mat having fastening strips. The positioning of the cushions may be adjusted to accommodate the length of the infant. The bottle support cushion is an arch that extends over the infant's body and holds a bottle in place for feeding the infant.

A TENTH EXAMPLE, U.S. Patent Office Publication No. 2004/022334, published on Nov. 11, 2004, to Rich teaches a baby bottle holder with a wide base for stability with a concaved based portion for resting upon an infant. The bottle holder has two self adjusting arms that grip the infant for hands free feeding leaving the care giver free to perform other tasks. Cylindrical like walls grip the bottle firmly and thereby allowing for easily insertion or removal of the baby bottle. The baby bottle holder retains the bottle at an angle that allowing the flow of liquids for comfortable feeding. The baby bottle holder also is shaped to act as a handle allowing the infant child to easily grip the bottle; and can be used as a teething toy.

AN ELEVENTH EXAMPLE, U.S. Patent Office Publication No. 2005/0103954, published on May 19, 2005, to Touma teaches a baby bottle holder which secures the bottle in a convenient hands-free position and allows a baby to receive liquid. The baby bottle holder is removably attached to a bib or other suitable article of clothing worn by the baby. The bottle is removably engaged by the baby bottle holder. At least one strap may be employed to fasten the bottle to the baby bottle holder.

A TWELFTH EXAMPLE, U.S. Patent Office Publication No. 2006/0102810, Published on May 18, 2006, to Banks teaches a hands-free baby bottle holding device used in order to eliminate the need for a caregiver to an infant to constantly hold a baby bottle while the infant is nursing a liquid. The hands-free baby bottle holder is comprised of: a foam block having a base support, a base upper edge, a right side support, a right side interior edge, a left side support, a left side interior edge, and a multitude of rounded edges; a bottle channel, to support and hold a baby bottle and baby bottle nipple; an outer fabric covering; a toy attachment tab; and a stuffed toy.

A THIRTEENTH EXAMPLE, U.S. Pat. No. 7,316,035, issued on Jan. 8, 2008, to Archambault teaches a multi-purpose burp cloth which allows parents or care-givers to perform other activities while feeding his or her baby by bottle that also acts as a baby diaper changing pad and pacifier holder. The burp cloth has a front side and a back side that are attached to one another by stitching. A pillow is located at an upper portion of the burp cloth and a clip is located just below the pillow on the front component while a strap is attached to the front side. To use the cloth, the user simply wraps the strap around the bottle and attaches the fastening means on a strap outer surface to a fastening means located on a strap inner surface. An alternate embodiment includes an adjuster located on a strap pair wherein the user feeds the end portion of the strap through the adjuster and pulls the strap so as to make the strap tight against the bottle. To use the cloth as a baby diaper changing pad, the user simply flips the cloth so that the back side is face up, places the baby's head onto the pillow and changes the diaper. The user may then wipe the back side with a disinfecting wipe to kill the germs.

A FOURTEENTH EXAMPLE, U.S. Patent Office Publication No. 2009/0038078, published on Feb. 12, 2009, to House teaches a pillow device which includes a first pillow, at least a second pillow, and a pillow covering having at least a first compartment and a second compartment. Such compartments each have a first end, second end, first side, second side, front, and back and are attached to each other such that at least one of such second end of such first compartment is attached to such second side of such second compartment closely adjacent such second end thereof and such second end of such second compartment is attached to such second side of such first compartment closely adjacent such second end thereof. Such first and second compartments each have an opening disposed closely adjacent at least one of such first end and such second end for enabling a user to insert such first pillow member into such first compartment and such at least such second pillow member into such second compartment.

It is apparent now that numerous innovations for restraining pillows and baby bottle supports have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a hands free baby bottle holder and feeder that avoids the disadvantages of the prior art.

ANOTHER OBJECT of the present invention is to provide a hands free baby bottle holder and feeder that is simple and inexpensive to manufacture.

STILL ANOTHER OBJECT of the present invention is to provide a hands free baby bottle holder and feeder that is simple to use.

BRIEFLY STATED, STILL YET ANOTHER OBJECT of the present invention is to provide a hands free baby bottle holder and feeder which includes a wedge shaped pillow and a U-shaped shaped pillow. A mechanism is for attaching the U-shaped pillow in an inverted position onto the wedge shaped pillow. A mechanism on the U-shaped pillow is for holding a baby bottle in position so that an infant placed onto the wedge shaped pillow between the U-shaped pillow can safely drink from the baby bottle.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

Figure 1:
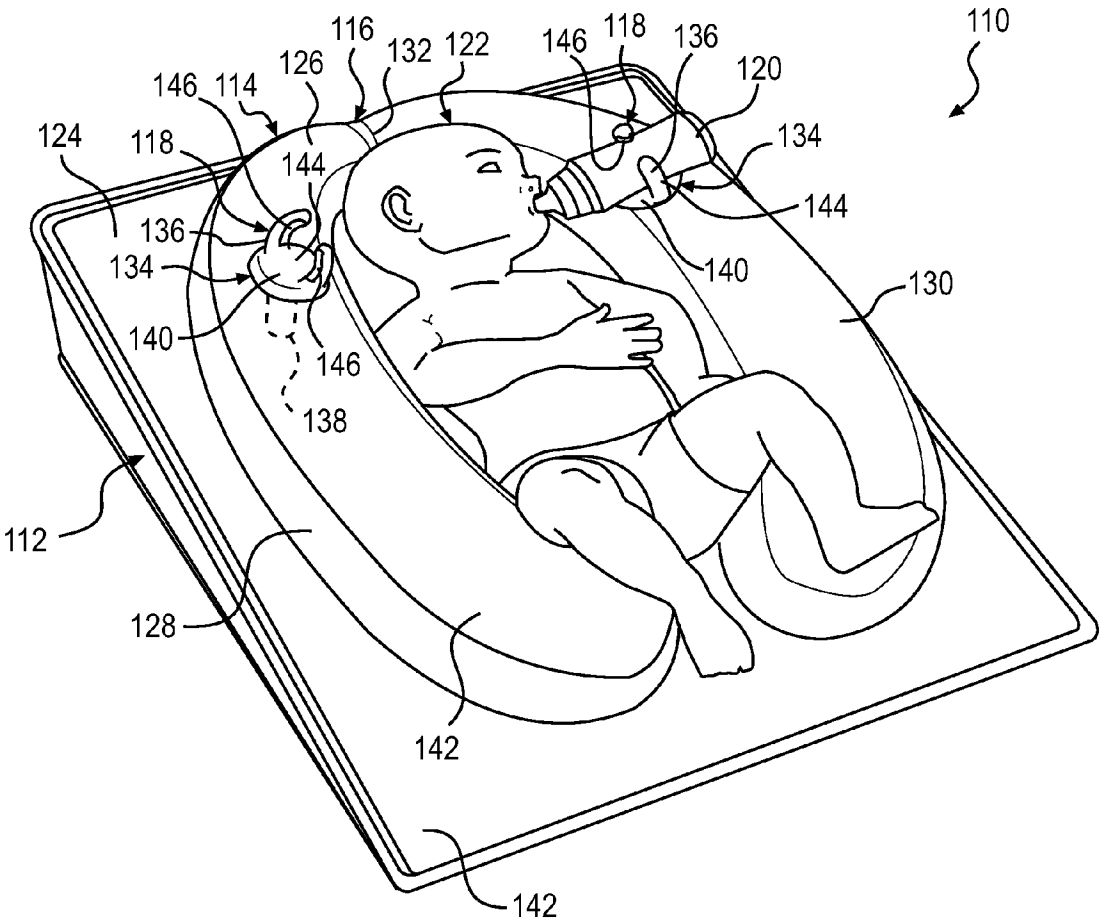
FIG. 1 is a perspective view of the present invention in use.

110 hands free baby bottle holder and feeder
112 wedge shaped pillow of holder and feeder 110
114 U-shaped pillow of holder and feeder 110
116 attaching mechanism of holder and feeder 110
118 holding mechanism of holder and feeder 110
120 baby bottle
122 infant
124 top surface of wedge shaped pillow 112
126 apex portion of U-shaped pillow 114
128 side arm of U-shaped pillow 114
130 side arm of U-shaped pillow 114
132 thread of attaching mechanism 116
134 C-clamp of holding mechanism 118
136 grip portion of C-clamp 134
138 anchor stem of C-clamp 134
140 ball and socket joint of C-clamp 134
142 memory foam material for wedge shaped pillow 112 and U-shaped pillow 114
144 plastic material for C-clamp 134
146 rubber material coated on grip portion 136

DETAILED DESCRIPTION OF THE PREFERRED EMBODIMENT

Figure 2:
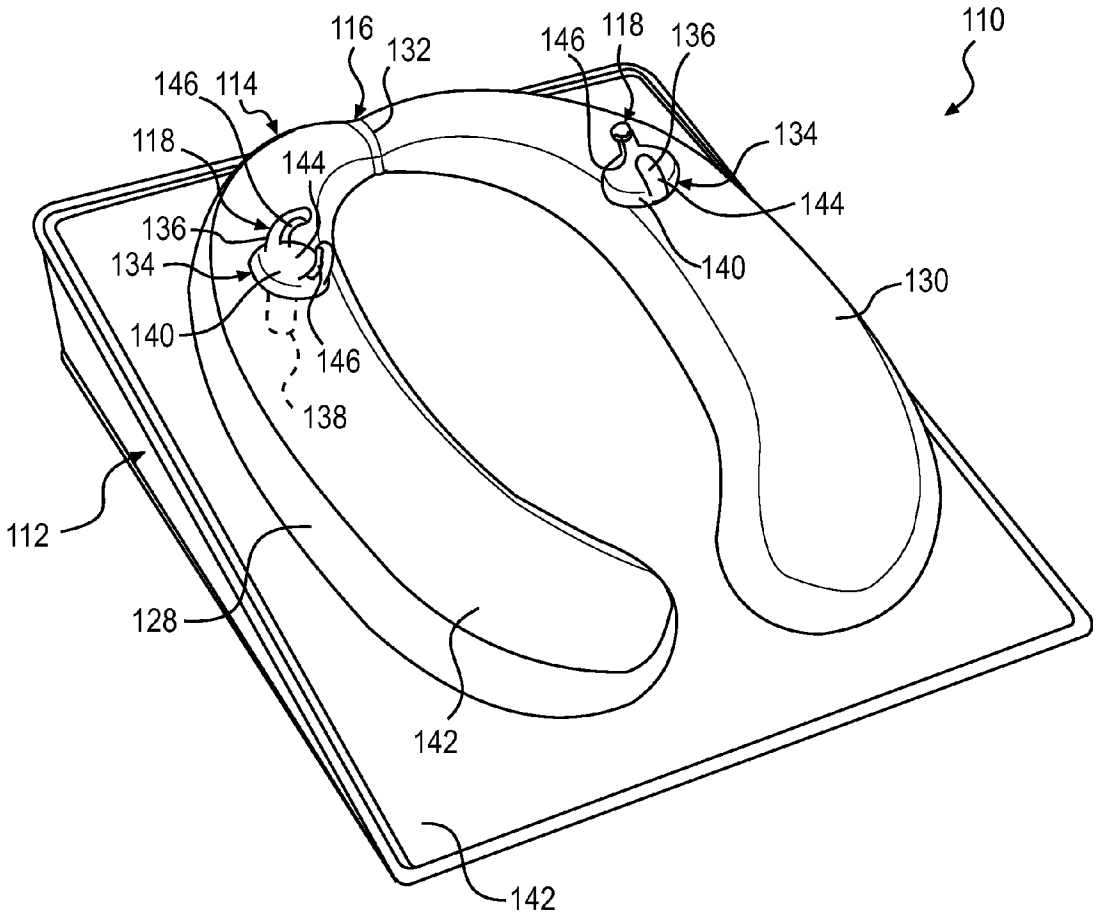
FIG. 2 is a perspective view of the present invention per se.
Figure 3:
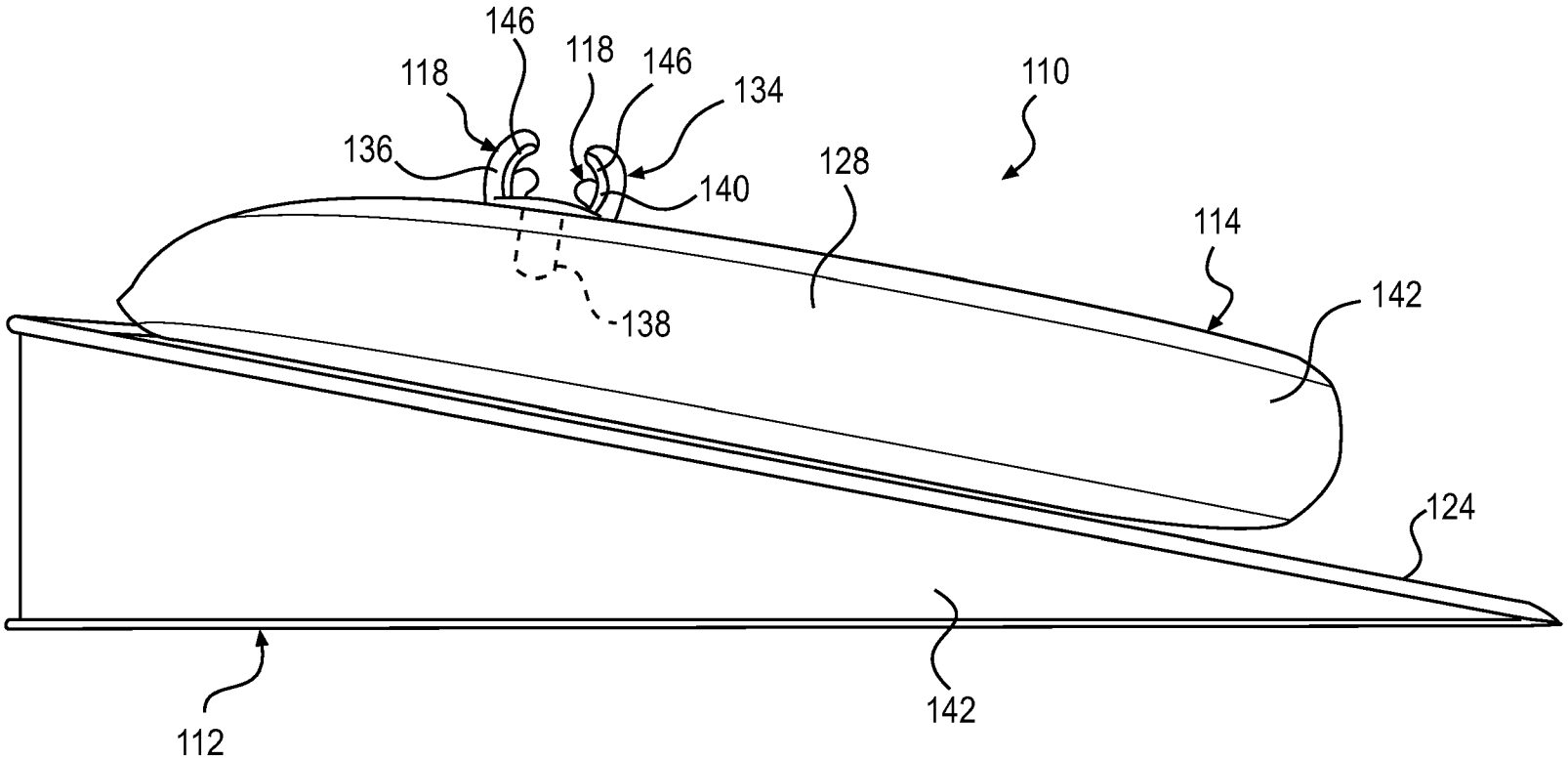
FIG. 3 is a side view taken in the direction of arrow 3 in FIG. 2.

Referring now to the figures, in which like numerals indicate like parts, and particularly to FIGS. 1 through 3, and as such, will be discussed with reference thereto.

The present invention is a hands free baby bottle holder and feeder 110 which includes a wedge shaped pillow 112 and a U-shaped shaped pillow 114. A mechanism 116 is for attaching the U-shaped pillow 114 in an inverted position onto the wedge shaped pillow 112. A mechanism 118 on the U-shaped pillow 114 is for holding a baby bottle 120 in position, so that an infant 122 placed onto the wedge shaped pillow 112 between the U-shaped pillow 114 can safely drink from the baby bottle 120.

The wedge shaped pillow 112 includes a top surface 124 angled downwardly at approximately fifteen degrees. The U-shaped pillow 114 includes an apex portion 126 and a pair of side arms 128,130. Each side arm 128,130 is integral with and extends from an opposite side of the apex portion 126. The side arms 128,130 are expandable and adjustable to accommodate the infant 122 securely therebetween. The attaching mechanism 116 includes thread 132 for sewing the apex portion 126 of the U-shaped pillow 114 onto the wedge shaped pillow 112. Other types of attaching mechanisms can also be utilized, such as adhesive or Velcro.

Figure 4:
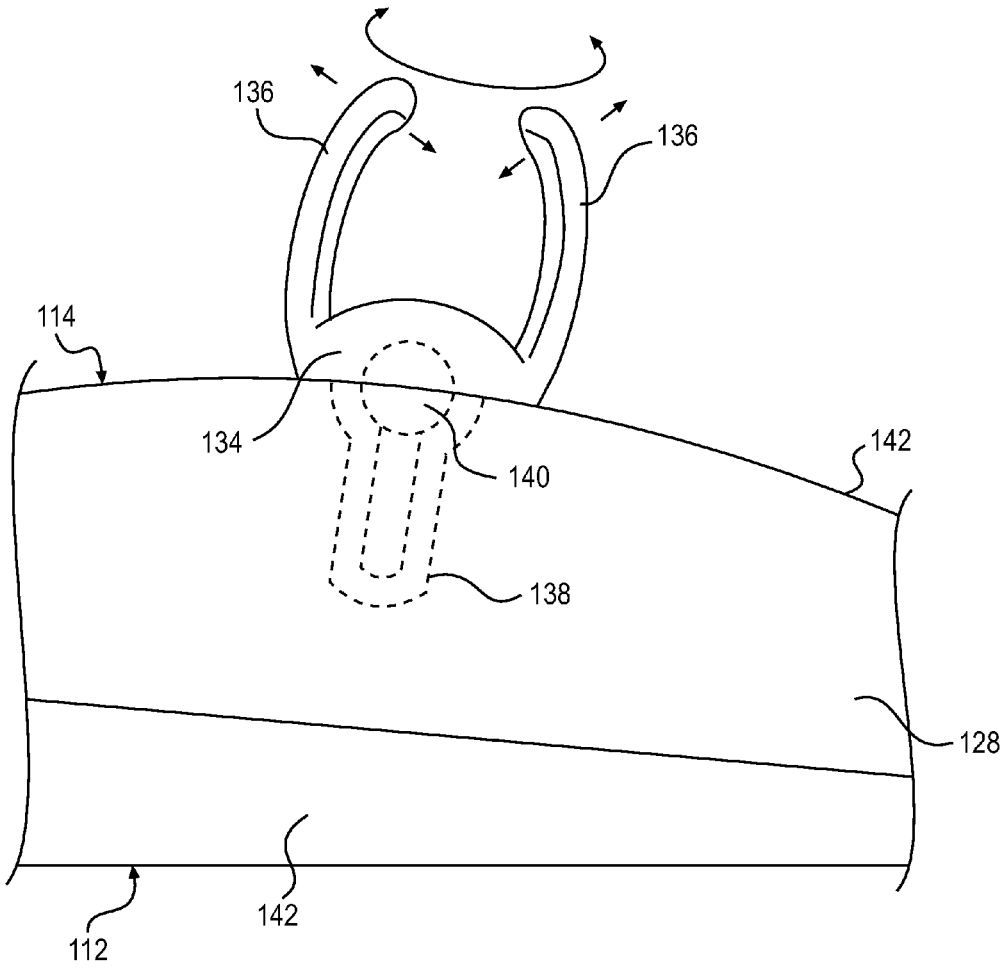
FIG. 4 is a side view of a ball and socket joint 140 of C-clamp 134.

The holding mechanism 118 includes a pair of C-clamps 134. Each C-clamp 134 is mounted onto one side arm 128,130 at approximately nine inches from the apex portion 126 of the U-shaped pillow 114, to allow the infant 122 to drink from the baby bottle 120. Each C-clamp 134 includes a grip portion 136 to hold the baby bottle 120. An anchor stem 138 extends within the side arm 128,130 of the U-shaped pillow 114 to retain the C-clamp 134 in place. As shown in FIG. 4: A ball and socket joint 140 on the anchor stem 138 allows the grip portion 136 to rotate three hundred and sixty degrees to prevent regurgitation when the infant 122 drinks from the baby bottle 120.

The wedge shaped pillow 112 and the U-shaped pillow 114 are comprised out of a memory foam material 142. Each C-clamp 134 is comprised out of a plastic material 144. The grip portion 136 of each C-clamp 134 is coated with a rubber material 146 to prevent the baby bottle 120 from slipping therefrom.

In summary the hands free baby bottle holder and feeder 110 is designed to allow an infant 122 to feed from a baby bottle 120 without the aid of a parent or caregiver. The present invention consists of two pillows 112,114 made of memory foam material 142. One pillow 112 is wedge shaped and angled at fifteen degrees on the top surface 124. The second pillow 114 is U-shaped. The apex portion 126 of the U-shaped pillow 114 is positioned at upper end of the top surface 124 of the wedge shaped pillow 112. The two pillows 112,114 are sewn together at the apex portion 126. The U-shaped pillow 114 is adjustable in width from the expandable side arms 128,130 at the apex portion 126 and will fit securely around the infant 122. One or two infants 122 may be positioned in the holder 110 at one time.

There are two C-clamps 134 made of plastic material 144 on the U-shaped pillow 114. The C-clamps 134 are located about nine inches from the attaching mechanism 116. The C-clamps 134 are designed to hold the baby bottle 120. One C-clamp 134 is located on each side arm 128,130. The C-clamps 134 include rubber material 146 coated on the grip portions 136, which will prevent the baby bottle 120 from slipping. As shown in FIG. 4: Each C-clamp 134 includes a ball and socket joint 140 that rotates three hundred and sixty degrees. The ball and socket joint 140 is retained by an anchor stem 138 located inside the U-shaped pillow 114. This mobility will prevent regurgitation when the infant 122 drinks from the baby bottle 120. The hands free baby bottle holder and feeder 110 may be available in a variety of colors. The exact specifications may vary.

It will be understood that each of the elements described above, or two or more together, may also find a useful application in other types of constructions differing from the types described above.

While the invention has been illustrated and described as embodiments of a hands free baby bottle holder and feeder, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hands free baby bottle holder and feeder which includes:

a) a wedge shaped pillow;

b) a U-shaped shaped pillow having an apex portion with a pair of side arms, seated on said wedge shaped pillow;

c) means for attaching the U-shaped pillow in an inverted position onto the wedge shaped pillow: and d) a holding means includes a pair of C-clamps, each mounted onto one side arm at approximately nine inches from the apex portion of the U-shaped pillow, to allow the infant to safely drink from the baby bottle.

2. The hands free baby bottle holder and feeder as recited in claim 1, wherein the wedge shaped pillow includes a top surface angled downwardly at approximately fifteen degrees.

3. The hands free baby bottle holder and feeder as recited in claim 1, wherein said pair of side arms, each integral with and extending from an opposite side of the apex portion, the side arms being expandable and adjustable to accommodate the infant securely therebetween.

4. The hands free baby bottle holder and feeder as recited in claim 3, wherein the attaching means includes thread for sewing the apex portion of the U-shaped pillow onto the wedge shaped pillow.

5. The hands free baby bottle holder and feeder as recited in claim 1, wherein each C-clamp includes:

a) a grip portion to hold the baby bottle;

b) an anchor stem extending within the side arm of the U-shaped pillow to retain the C-clamp in place; and c) a ball and socket joint on the anchor stem to allow the grip portion to rotate three hundred and sixty degrees to prevent regurgitation when the infant drinks from the baby bottle.

6. The hands free baby bottle holder and feeder as recited in claim 1, wherein the wedge shaped pillow and the U-shaped pillow are comprised out of a memory foam material.

7. The hands free baby bottle holder and feeder as recited in claim 1, wherein each C-clamp is comprised out of a plastic material.

8. The hands free baby bottle holder and feeder as recited in claim 5, wherein the grip portion of each C-clamp is coated with a rubber material to prevent the baby bottle from slipping therefrom.

* * * * *